US005778956A

United States Patent [19]

Judkins

[11] Patent Number: 5,778,956

[45] Date of Patent: Jul. 14, 1998

[54] VENETIAN BLINDS WITH LATERAL TILT

[76] Inventor: Ren Judkins, 46 Newgate Rd., Pittsburgh, Pa. 15202

[21] Appl. No.: 802,310

[22] Filed: Feb. 18, 1997

[51] Int. Cl.[6] ..... E06B 9/26

[52] U.S. Cl. ..... 160/176.1 R

[58] Field of Search ..... 160/176.1 R, 177 R, 160/168.1 R, 176.1 V, 168.1 V, 172 R, 178.1 R, 174 R

[56] References Cited

U.S. PATENT DOCUMENTS

| | | | |
|---|---|---|---|
| 2,201,356 | 5/1940 | Terrell | 156/16 |
| 2,307,278 | 1/1943 | Krantz | 160/173 |
| 2,420,301 | 5/1947 | Cusumano | 160/176.1 R X |
| 2,572,291 | 10/1951 | Weaver | 160/176.1 R X |
| 2,611,426 | 9/1952 | Randall | 160/176.1 V |
| 2,687,770 | 8/1954 | Walker et al. | 160/176 |
| 2,748,852 | 6/1956 | Akerstrom | 160/168.1 R |
| 2,756,815 | 7/1956 | Turkowski | 160/168.1 V X |
| 2,795,271 | 6/1957 | Angelo | 160/172 |
| 2,905,237 | 9/1959 | Clark | 160/176.1 V |
| 3,014,525 | 12/1961 | Zytka | 160/168.1 V |
| 3,100,013 | 8/1963 | Randmark | 160/176.1 R X |
| 3,294,153 | 12/1966 | Fountain | 160/163 |
| 3,534,801 | 10/1970 | Bolden | 160/176.1 V X |
| 4,377,194 | 3/1983 | Tsuhako | 160/168.1 R |
| 5,339,882 | 8/1994 | Judkins | 160/84.1 |
| 5,573,051 | 11/1996 | Judkins | 160/176.1 R X |
| 5,664,614 | 9/1997 | Debs | 160/168.1 R |

*Primary Examiner*—David M. Purol
*Attorney, Agent, or Firm*—Buchanan Ingersoll, P.C.

[57] ABSTRACT

A tilt mechanism for venetian type blinds has a pair of straps and connecting cross bars which form a parallelogram. The front rails of the ladders are connected to one strap and the rear rails of the ladders are connected to the other strap. Movement of the straps toward one another moves the rails of the ladder toward one another and in opposite vertical directions and tilts the blind slats resting on the ladder.

7 Claims, 9 Drawing Sheets

VENETIAN BLINDS WITH LATERAL TILT

FIELD OF INVENTION

The invention relates to a venetian type blind and tilt mechanism for use in venetian type blinds.

BACKGROUND OF THE INVENTION

Venetian type blinds have a series of slats hung on ladders which extend from a headrail to a bottomrail. In most venetian blinds a pair of lift cords is provided each having one end attached to the bottomrail and then passing through elongated holes in the slats up to and through the headrail. A cord lock is usually provided in the headrail through which the lift cords pass. The cord lock allows the user to maintain the blind in any desired position from fully raised to fully lowered.

The slats rest on rungs between rails of the ladders. The blind is in an open position when the rungs are horizontal. To close the blind one lifts one rail while allowing the other to either remain in place or be lowered. This raises one end of each rung tilting the slats. Thus, when the blind is closed there is typically tension on one rail while the other rail of the ladder is not in tension.

The ladder rails initially used for venetian type blinds consisted of a fabric tape typically from one to two inches in width. The rungs were also made of fabric strips. Consequently, the lift cords passed through holes in the slats which were aligned between the rails of the ladder. When the blind was closed, the fabric rails covered the holes. Consequently, there was no concern about light passing through the holes when the blind was in a closed position.

Very few tape type ladders are used in blinds today. Rather, the art has adopted ladders formed of cord rails having cord-type rungs between them. Typically, the rungs are multiple strands of cord. However, a single strand of cord has also been used. Frequently, a braided cord is used for the ladder rails. The conventional lift cord arrangement in which the lift cord passes through elongated holes in the slats is used. The lift cords are aligned to be between the rails of the ladders which are provided near opposite ends of the blind.

In the venetian blinds which utilize a cord-type ladder the blinds are opened and closed by lifting or lowering one of the ladder rails relative to the other. In most blinds the lateral position of the ladder rails relative to one another remains unchanged at the headrail or does not shift sufficiently to keep the center of gravity in the center of the blind. Thus, there will be slack at the top of one of the ladder rails and the center of gravity shifts forward or back when the blind is tilted. This requires a tilting mechanism that can actually lift and hold the weight of the blind.

I have described two new types of venetians in my U.S. Pat. Nos. 5,573,051 and 5,339,882. These designs require tilting systems that can tilt the lift cords as well as rails of the ladders. The blind in U.S. Pat. No. 5,573,051 has notched slots in the edges of the slats and uses the tension in the lift cords to restrain the slats from moving laterally. For best results, the tension should be present at all times even when tilting to retain the slats.

The shade in U.S. Pat. No. 5,339,882 uses two window sized pieces of sheer fabric or see-through material in planes parallel to the glass and function in the same amer as the ladders in an ordinary venetian. It uses slats that are connected substantially along their entire length to function both as the rungs and the louvers. The slats do not need to be rigid because the planes of fabric support them continuously.

Holes within the slats for the lift cords to pass through allow light leakage which is very distracting from the overall continuous fabric look. This type of blind closure is difficult to accomplish and the interior of the blind is inaccessible. An improved version is described in U.S. patent application Ser. No. 08/293,751, filed on Aug. 22, 1994. That blind uses ribbon inserts that lay on top of the slats to give a wide choice of colors and fabrics. To eliminate the holes in the slats, to restrain these inserts from moving laterally, and to maximize closure, it is preferred to have lift cords that run along the edges of the slats and which are under tension at all times.

Slats made of wood have become increasingly popular, but because they are thicker the stack becomes very large. It would be desirable to make a headrail that was much thinner so that the larger wood stacks would fill less of the window.

SUMMARY OF THE INVENTION

I provide a very thin and versatile tilting and lifting mechanism for venetian type products. It can be used with blinds that have slots in the edges of the slats instead of holes, with fabric venetians, and with blinds that have holes in the middle of each slat.

The ladder rails move together when the blind is tilted and apart when it is opened and the load is evenly distributed between the two rails of each pair. This simplifies the mechanism required to tilt the blind since it does not have to lift the blind and shift the center of gravity.

The preferred embodiment has a combination cord operated tilt driver and reciprocating cord locks on one end. The operator ends of the tilt cords attach to a mono control wand through which the lift cords pass and terminate at a lift cord pull. There is a cradle at each route opening that provides turning surfaces for the lift cords and the ladder rails to go from horizontal orientation in the headrail to a vertical orientation in the blind. The cradle also contains a tilting bar or disk that affects the tilt of the ladder rails. The lift cords and ladder rails can attach to a conventional single bottomrail or to a novel double bottomrail which improves closure and also allows for the lift cord pairs that run outside of the slats to pass around pulleys and then back up to the headrail to affect a 2 to 1 lifting ratio for heavier blinds. This is possible because double bottomrails always hang plumb instead of tilting so that a pulley within the bottomrail maintains a constant orientation to the lift cords.

Other objects and advantages of the present invention will become apparent from a description of the present preferred embodiments shown in the drawings.

DESCRIPTION OF THE PREFERRED EMBODIMENTS

Figures 1, 2:
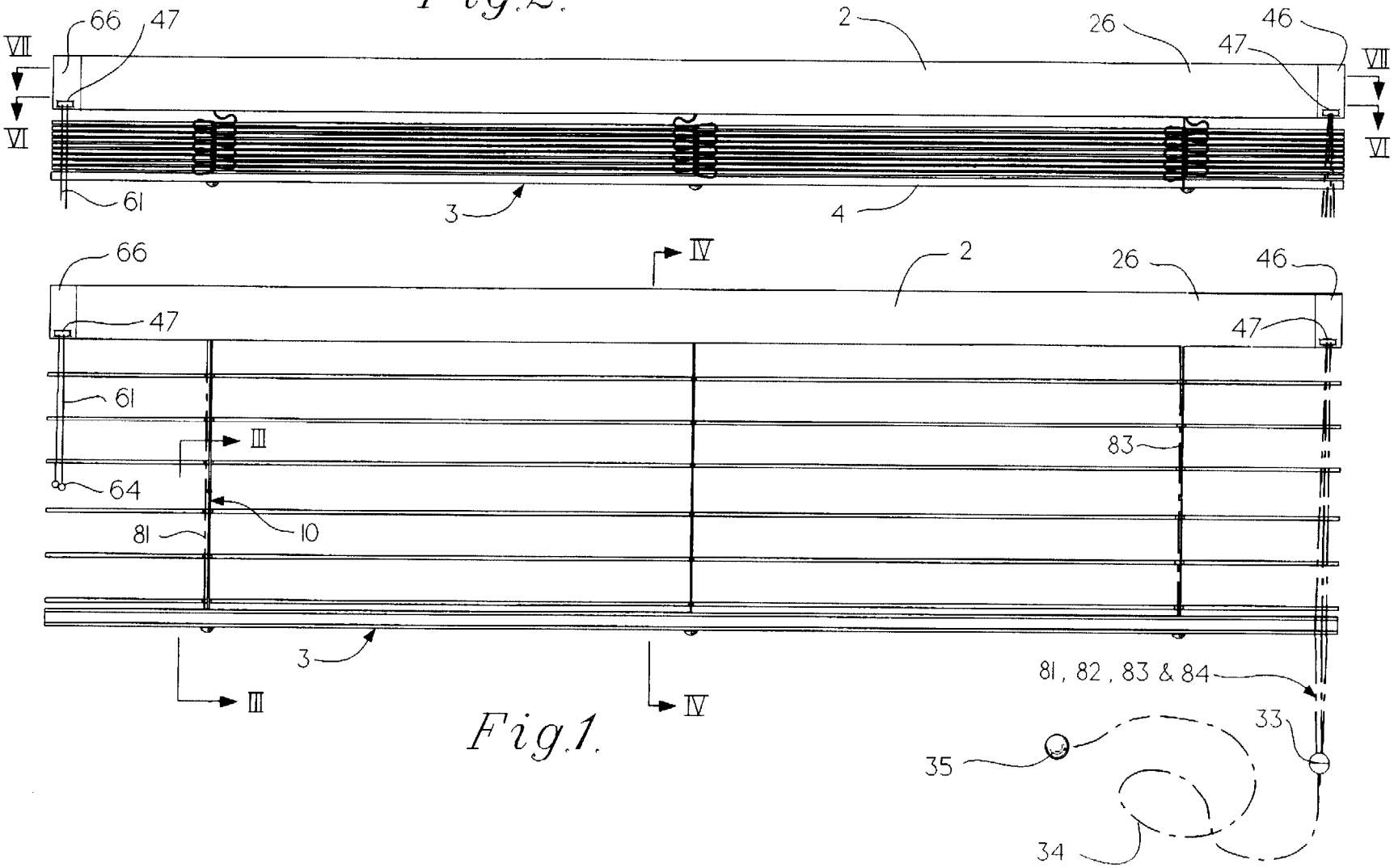
FIG. 1 is a front view of the present preferred embodiment of my venetian type blind shown in a lowered open positioned.
FIG. 2 is a front view similar to FIG. 1 showing an upper portion of the blind when the blind is in a raised position.
Figure 3:
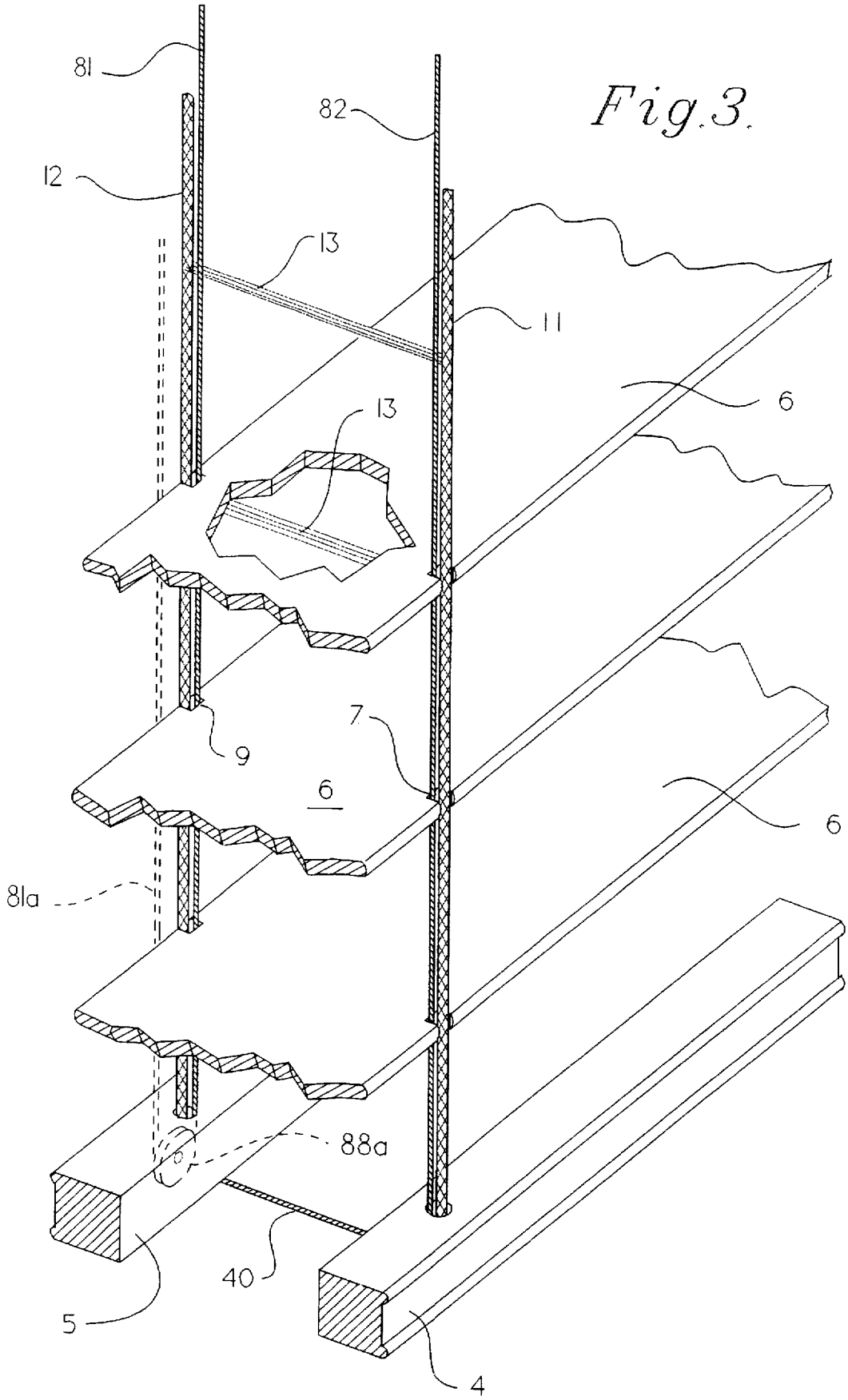
FIG. 3 is a sectional view taken along the line III—III of FIG. 1.
Figure 9:
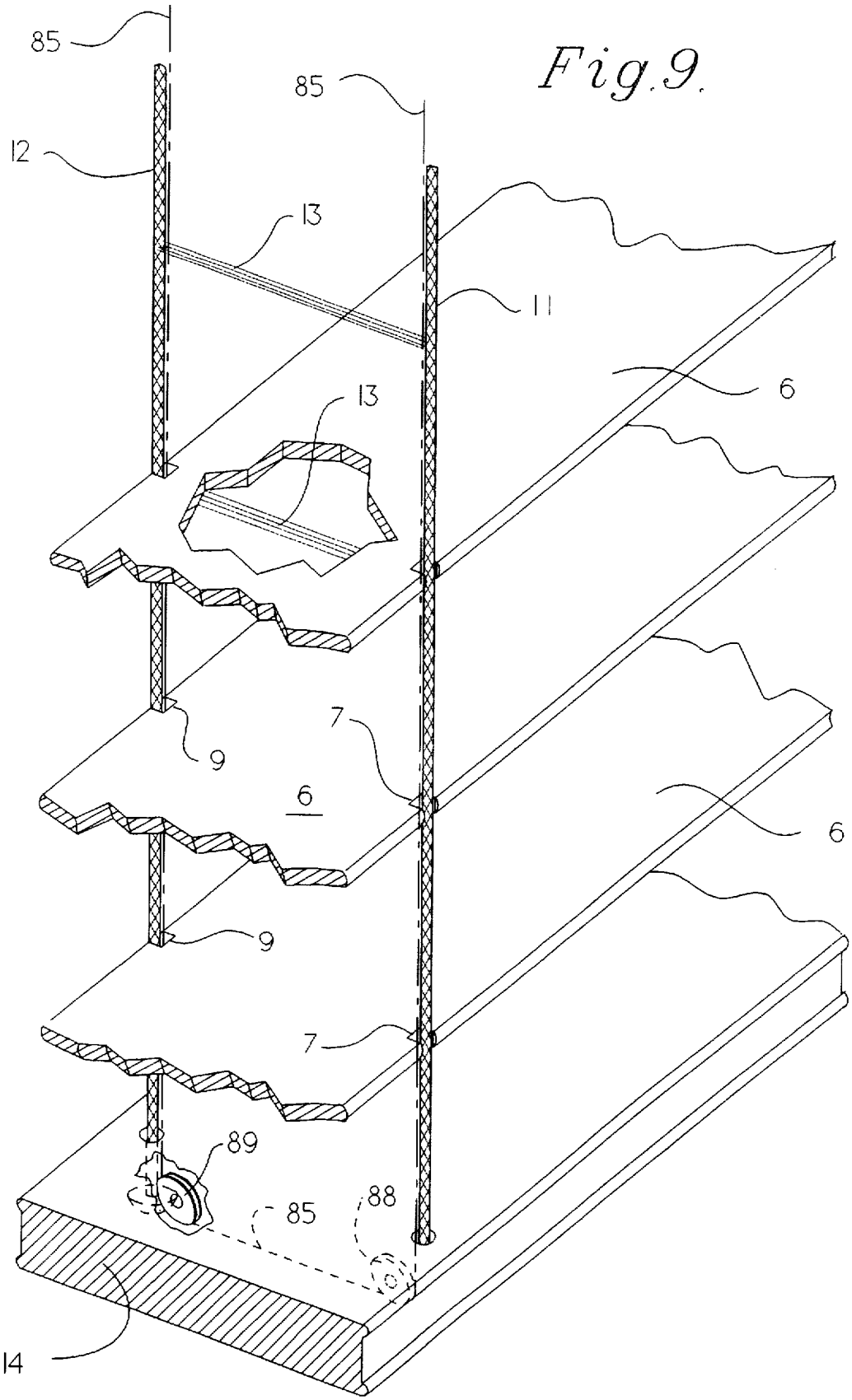
FIG. 9 is a perspective view similar to FIG. 3 showing an alternative routing for the lift cords.

The first present preferred embodiment is comprised of a headrail 2, a bottomrail 3 preferably having two pieces 4 and 5 and a set of slats 6 extending therebetween. If desired, a one piece bottomrail 14 such as shown in FIG. 9 could be used. For purposes of illustration, only six slats are shown. However, the blind could have any number of slats and likely would have many more slats than are shown. The slats of this embodiment are symmetrical to a horizontal plane passing through the front and back edges of the slat. Crowned, "S" shaped, "Z" shaped, symmetrical, or asymmetrical slats may be used in place of these flat slats if desired. The slats are suspended on a cord type ladder 10. The ladder has a front rail 12, rear rail 1 1 and series of rungs 13 extending therebetween on which these slats rest. As shown most clearly in FIG. 4, the bottom ends of the ladders are knotted within the bottomrails 4 and 5 and covered by plugs 42. Cords 40 are provided to tie the bottomrails 4 and 5 together and prevent them from flaring out. At least two front slots 7 are provided on the front edge of each slat 6. A corresponding set of rear slots 9 have been cut into the back edge of slat 6 opposite slots 7. I prefer to have the slots 7 and 9 directly opposite one another as shown in FIG. 3. However, one slot could be to the left or right of the other slot. The slots are sized so that lift cords 81, 82, 83 and 84 and possibly the ends of rungs 13 can loosely fit therein. Tilt ladders 10 are positioned near the ends of the blind so that the rails 11 and 12 are adjacent the lift cords. A third tilt ladder is provided at the center of the blind where no lift cords are needed. Slots 7 and 9 preferably have a depth such that only the lift cords 81, 82, 83 and 84 and ends of rungs 13 can completely fit therein. Thus, the rails 11 and 12 can never be fully within the slots. For purposes of illustration the lift cords 81 and 83 are shown in chain line in FIG. 1 so as to distinguish them from the adjacent rails of the tilt ladders or other structures. Because lift cords travel within slots 7 and 9 provided in the slats 6 there are no cord holes in the slats. As can be seen in FIG. 3 the slats 6 rest on rungs 13 of the tilt ladder 10 and can easily be lifted from the rungs for cleaning or repainting.

The number of lift cords that are used will vary according to the size of the blind and the cording arrangement. In every embodiment lift cords should be positioned near either end of the blind in slots on both the front and rear edges of the slats. In the embodiment of FIG. 1, four lift cords extend from the bottomrail through the headrail. As shown most clearly in FIGS. 1 thru 3, lift cords 83 and 84 extend from the front bottomrail 4 through slots 7 in the front edge of slats 6. Lift cords 81 and 83 extend from the rear bottomrail 5 through slots 9 in the rear edge of slats 6. The lift cords pass through the headrail 2 exiting on the front right side as shown in FIGS. 1, 2, 8*a* and 8*b*. The front lift cords 81 and 83 are threaded through the headrail over rollers 36 and into the front lift cord lock 38 which is pivotally attached to the front tilter strap 41. They continue on around the front pulley 44 and out of the front port 47 of the end cap 46. The cords extend down to a position the operator can reach and pass into a handle or ball 33. The rear lift cords 82 and 84 are threaded in a similar manner except they pass through the rear cord lock 39, then the rear pulley 44'. The cord locks are always engaging the lift cords unless the blind is being raised or lowered. The bottomrails are preferably supported by the lift cords except when the blind is fully extended when the ladder rails may partially support the bottomrails. This keeps tension on the lift cords at all times.

Figure 4:
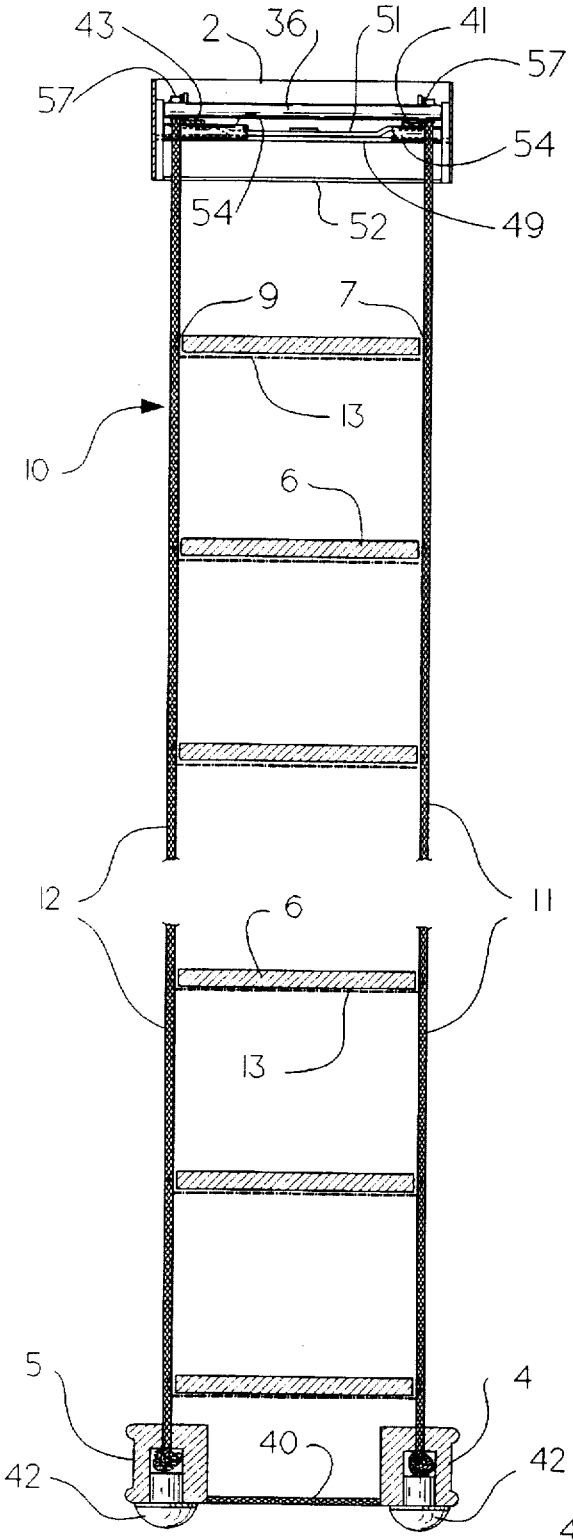
FIG. 4 is a sectional view similar to FIG. 3 taken along the line IV—IV of FIG. 1.

The lift cords 81, 82, 83 and 84 may be tied to plugs 42 of the type as shown in FIG. 4. Alternatively, pulley plugs 88 and 89 can be used as shown in FIG. 9. Then, the lift cords 85 will pass around the pulleys 88 and 89 and travel back up the ladder rails. The pulley plugs could be oriented as shown by pulley plug 88*a* in FIG. 3. Then the return leg of the lift cord 81 preferably does not travel the same path as the descending leg since this would cause excessive friction. The return leg 81*a* may be intertwined with the ladder rungs occasionally or pass through special loops (not shown) on the outside of the ladder with its end attached to the headrail.

Figure 5:
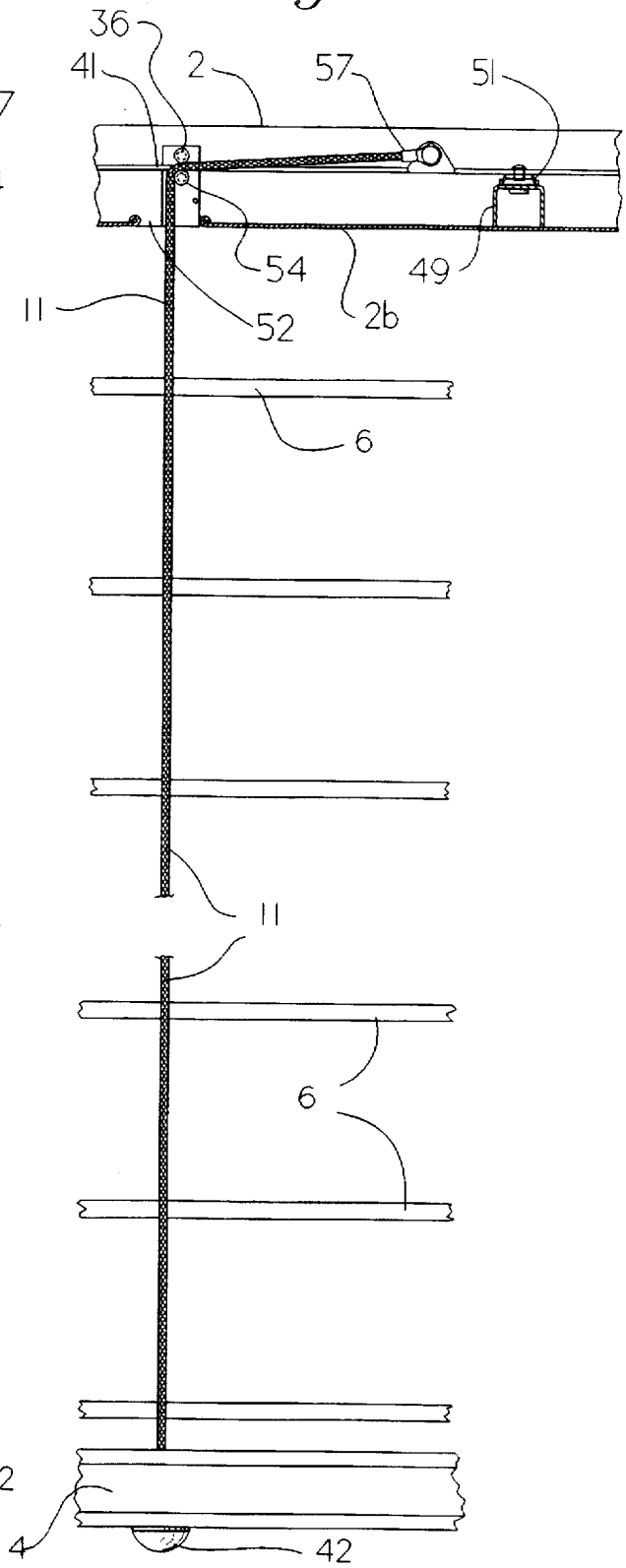
FIG. 5 is a fragmentary view showing a portion of the blind near the line IV—IV of FIG. 1.
Figure 6A:
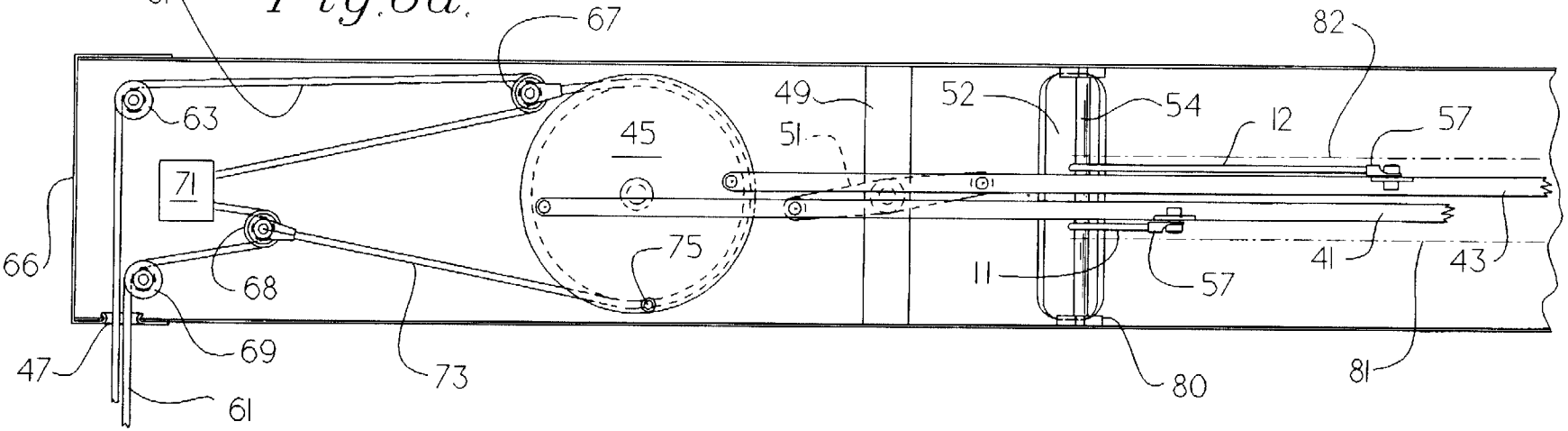
FIGS. 6*a* and 6*b* show the opposite ends of a sectional view of the headrail taken along the line VI—VI in FIG. 1 with the tilt mechanism in a first closed position.
Figure 7A:
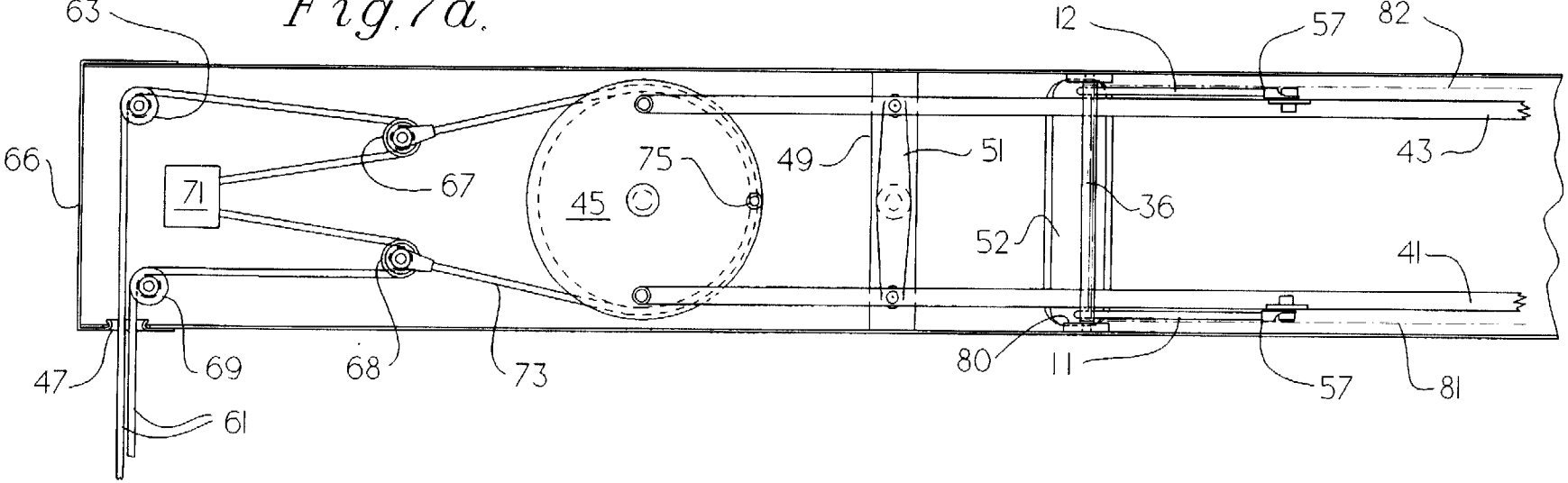
FIGS. 7*a* and 7*b* show the opposite ends of a sectional view of the embodiment of FIG. 6 taken along the line VII—VII of FIG. 1 showing the tilt mechanism in an open position.
Figure 6B:
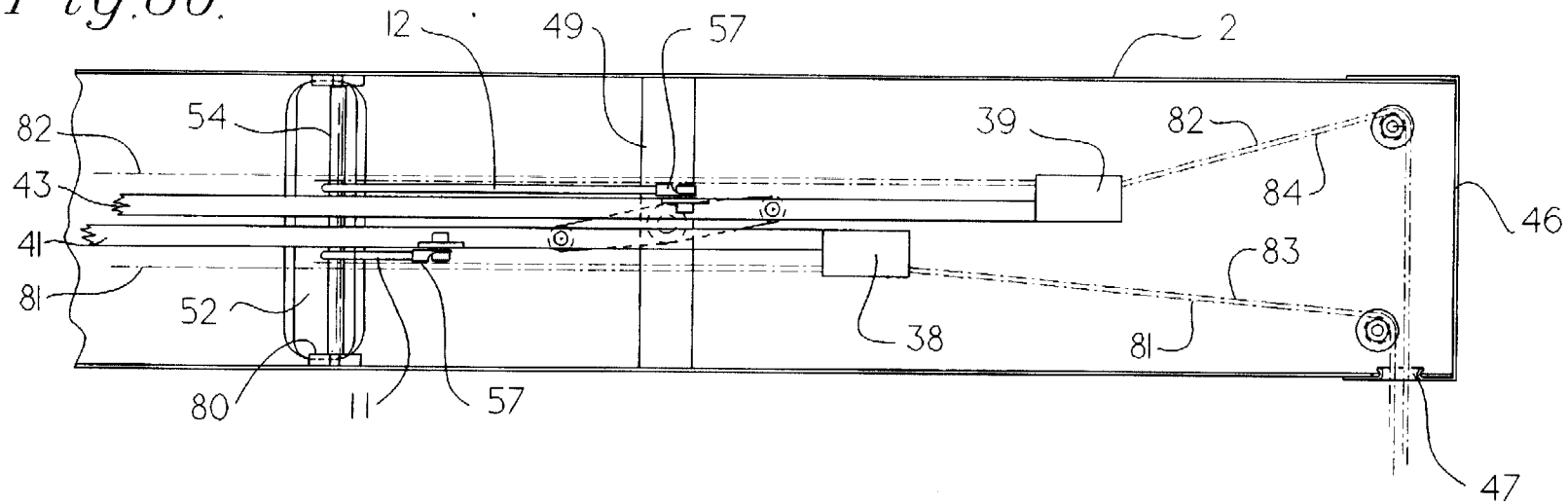
Figure 7B:
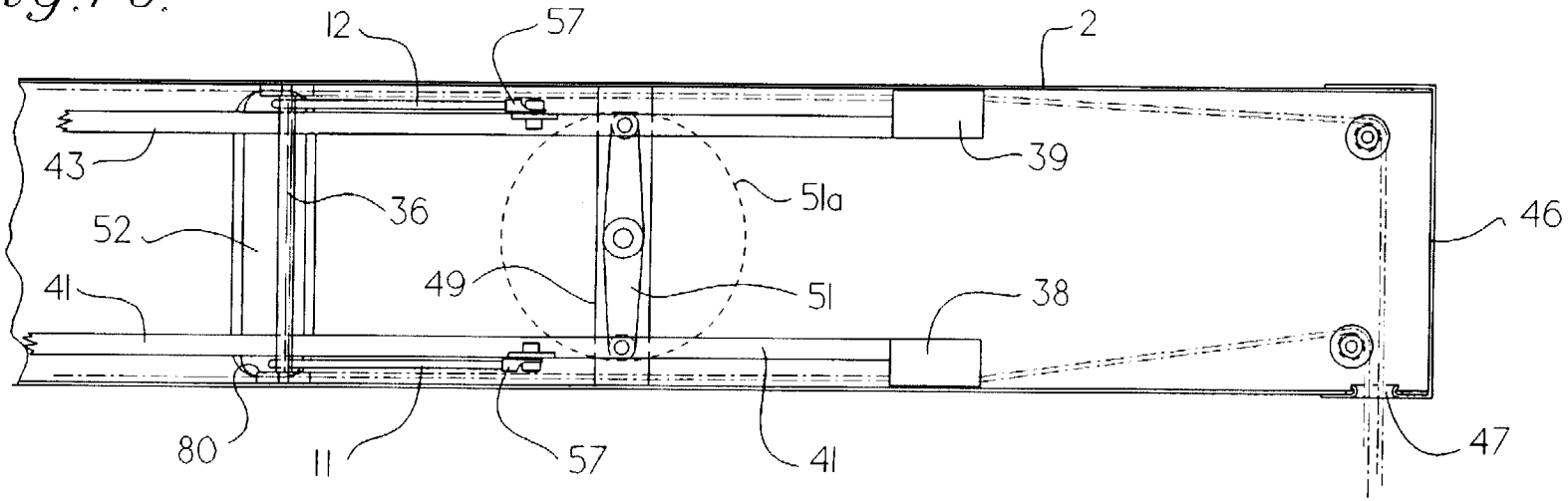
Figure 8A:
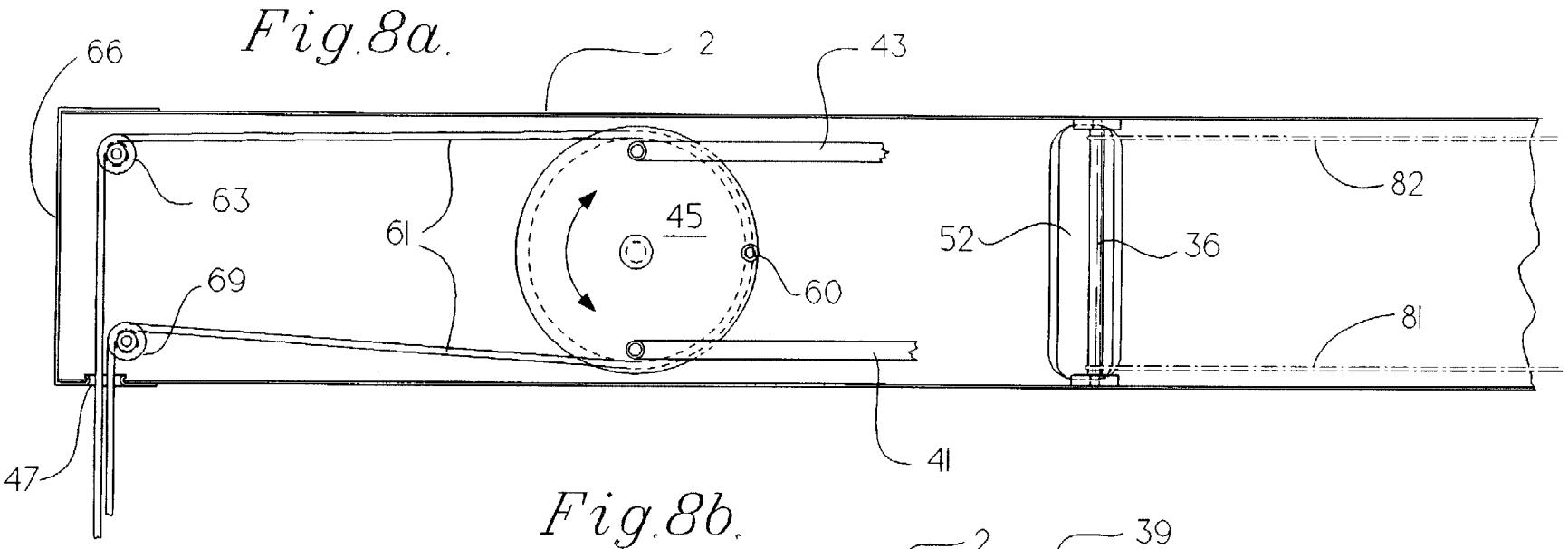
FIGS. 8*a* and 8*b* show the opposite ends of a sectional view taken along the line VI—VI in FIG. 1 with a portion of the tilt mechanism cut away.
Figure 8B:
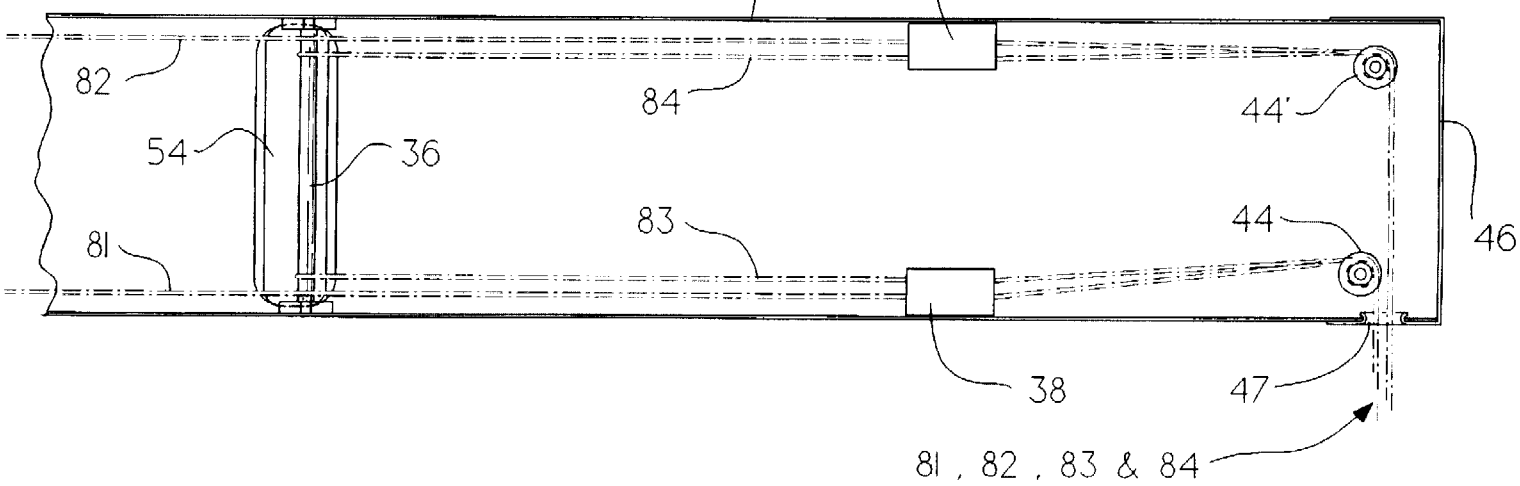

The front rails 12 and rear rails 11 of the cord type ladders 10 are tied to the respective bottomrails 4 and 5 just above the plugs 42. The other ends of the rails pass over the rollers 54 and connect to their respective straps 41 and 43 via clips 57. In FIGS. 4 and 5, the space between the bottom 2*b* of the headrail 2 and the straps is exaggerated so that the straps can be easily seen. In a preferred embodiment this space is less than 0.25 inches.

Figure 10A:
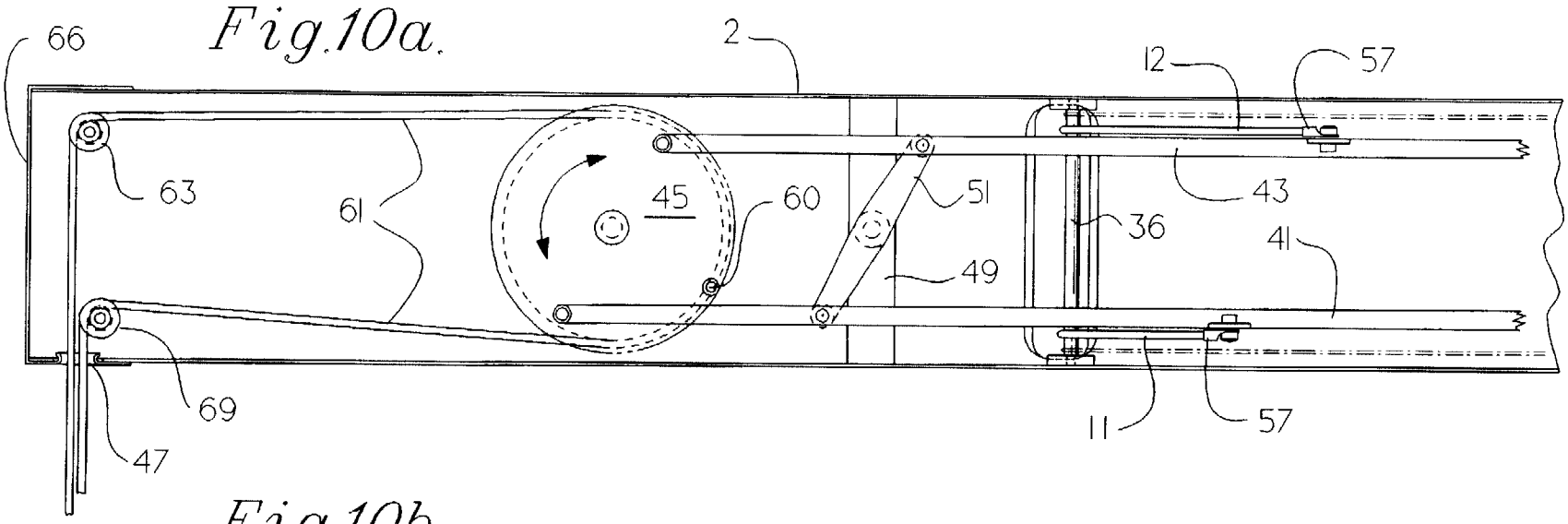
FIGS. 10*a* and 10*b* show the opposite ends of a second preferred tilt mechanism in an open position when viewed along the line VI—VI in FIG. 1.
Figure 10B:
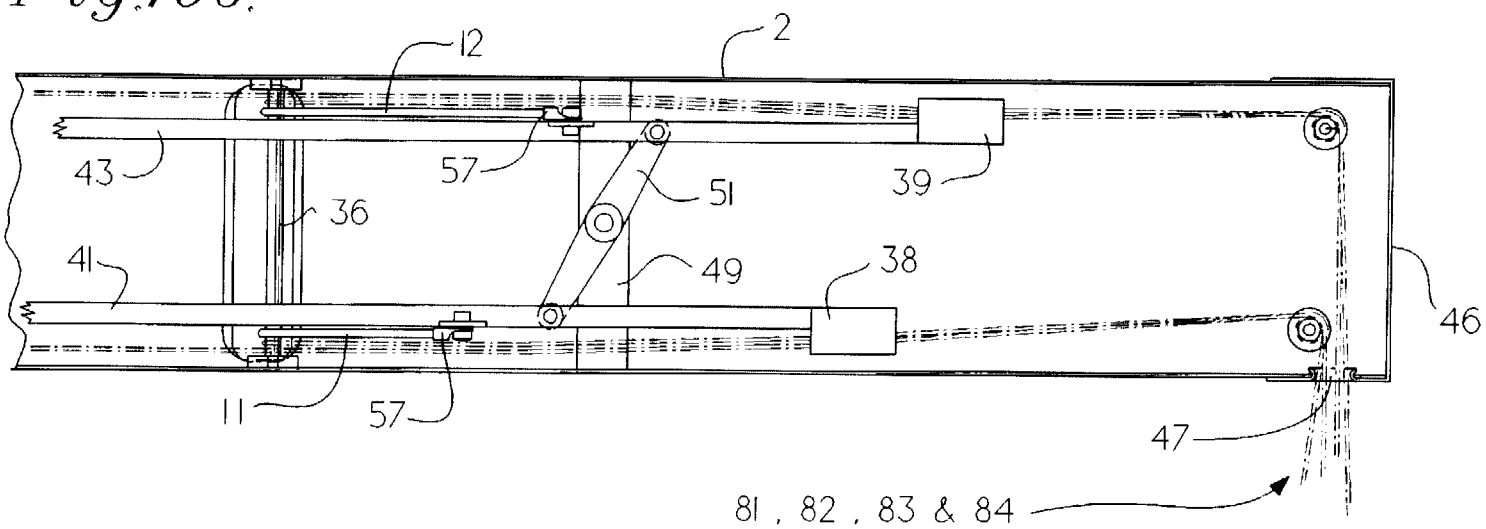

In the preferred embodiment shown in FIGS. 1, 2, 6*a*, 6*b*, 7*a* and 7*b* there are two tilt cords 61 each attached to a tilt tassel 64. The cords from the tassels 64 pass into the front port 47 of the left end cap 66. One cord goes around the fixed, rear pulley 63 through the rear belt end pulley 67 and then ties at the common tie-off 71 on the end cap 66. The other cord goes around the fixed, front pulley 69 through the front belt end pulley 68 and then ties at the common tie-off 71 on the end cap 66. The belt end pulleys 67 and 68 are at either end of the belt 73 which loops around and is connected at its center point 75 to the tilt sheave or tilt driver 45. The connection point 75 is on the medial side of the tilt driver 45 and travels 180° from the backside to the front side of the headrail 2 as the blind is tilted from closed in one direction to closed in the other direction. Belt end pulleys 67 and 68 are free to move as the tilt cords 64 are advanced and retracted. In an alternative embodiment shown in FIGS. 10*a* and 10*b*, the tilt cords 61 are connected directly to the tilt driver 45 at connection point 60.

Front and rear straps 41 and 43 are pivotally connected on the opposite ends of a diameter of the tilt driver 45 and interconnected by bars 51 and supported by support 49. Bars 51 could be disk shaped as indicated by dotted line 51*a* in FIG. 7*b*. The cradle may be as wide as the disk. The reciprocating cord locks 38 and 39 are preferably fixed on top of each strap at the end opposite the connection to the tilt driver 45. Cord locks 38 and 39 could be movably attached to the headrail if a linkage (not shown) is provided between each strap 41, 43 and the associated cord lock 38, 39. The preferred straps 41 and 43 are each made of continuous pieces of spring steel and extend from the tilt driver on one end of the blind to the cord locks on the other end. They could be made of any material that does not stretch under the loads required to tilt the blind and may be shaped in ribbons, rods, or cables. The straps do not have to be continuous pieces, but could be segments that extend from support to support 49 and the cradle 80 is spanned by separate segments between two supports on either side of the cradle that forms parallelogram at each route opening. The cradle and adjacent supports can all be attached to one base to simplify fabrication. The preferred embodiment has two straps 41 and 43 that are nearly the length of the headrail and are punched at the same time in the same machine as the headrail to assure accurate alignment.

The straps 41 and 43 connect to crossbars 51 that can be pivotably connected at their centers to supports 49. The supports 49 are placed at or near each ladder location. The straps 41 and 43 with the pivoting crossbars 51 create parallelogram geometry in the vicinity of each support 49. This parallelogram geometry synchronizes the lateral and transverse motion of the straps 41 and 43 and causes them to always remain parallel and move in equal but opposite directions. The straps 41 and 43 move towards the longitudinal axis of the headrail 2 when the blind is tilted and force the lift cords and the ladder rails that are between or adjacent them to come together as well. The supports 49 can be positioned to straddle the openings 52 in the headrail through which the ladder rails 11 and 12 and the lift cords 81, 82, 83 and 84 pass. The cradles which are mounted at the route openings also support the lower rollers 54 that bend and support the ladder rails and the upper rollers 36 that bend and support the lift cords. I prefer that the straps 41 and 43 rest on rollers 54 so that the rollers 54 support the straps. This can be seem in FIG. 5. Both sets of rollers 54 and 36 may or may not be free to rotate. The cradles that support the rollers also reinforce the headrail 2 where it is cut out for the cord routes. That is where the weight of the slats and the bottomrail is supported.

I prefer to connect the tilt cords 61 through one of the belt pulleys 67 or 68 with a 2:1 mechanical advantage. The belt 73 rotates the tilt driver 45 which translates the straps 41 and 43, as well as reciprocating cord locks 38 and 39 laterally and transversely. This motion is duplicated at each cradle 80 because of the parallelogram geometry. The clips 57 are placed on the straps 41 and 43 so that the clips 57 never come over the headrail opening 84 When the straps 41 and 43 move, the ladder rails 11 and 12 move up and down and inward or outward. They also move the lift cords inward and allow the lift cords to move outward when the slats 6 move to the horizontal opening or open position. The reciprocating cord locks 38 and 39 move the lift cords up and down in tandem with the ladder rails 11 and 12 which in turn tilt the slats 6. The lift cords tilt the bottomrails 3 and 4. The rails 11 and 12 may also tilt the bottomrails when the blind is fully extended.

In the preferred bottom and top stacking embodiment, the lift cords are attached to two moving rails. The ladder rails are also attached to the moving rails or to the corresponding lift cords. Another set of centerline lift cords pass from a single bottomrail up through route holes in each slat and then over a second lift roller that is placed on the opposite side of the route opening in the headrail from the first set of rollers. These cords are routed to a fixed cord lock that is mounted opposite the tandem cord locks.

Another embodiment of the bottom and top stacking blind would have a second tilt driver with reciprocating cord locks on the opposite side of the headrail from the first tilt driver. The second set of lift cords would pass through these locks over the second lift roller and through the edge slots in the slats and attach to a single or double bottomrail.

There can be a conventional pull or pulls on the operator ends of the lift cords that run through reciprocating lift cords. However, it may be desirable to have a special cord pull with reciprocating weights because half of the cords move up and half move down when the blind is being tilted and this makes the cords loop and be less attractive when the blind is tilted. The pull could be a tube and the two weights would be hidden inside with the outside lift cords attached to one weight and the inside cords attached to the other weight. The weights would be configured so that they could move past each other and travel the width of the slats.

The reciprocating cords locks allow the cords to move freely at all times out of the headrail and lock automatically to oppose the weight of the shade whenever the cord moves into the headrail. To lower the shade the locks are released or opened by a mechanical linkage that the operator can activate. The preferred linkage is a yoke that pulls the cord lock furthest from the end of the blind back towards the other lock until they are in side by side position before they are opened. The locks are preferably configured so that they can only open when they are side by side and when the release linkage is being activated by the operator. This compensates for changes in the positions of the lift cords relative to the ladder rails that can be induced by the operator when she lifts or lowers the blind, since tugging on the lift cord pull will always bring the lift cords to an even or non-tilted position whether the ladders are tilted or not.

An alternative cording arrangement shown in FIG. 9 utilizes two lift cords and pulleys in the bottomrail 14. The lift cords 85 and 86 are routed from the operator to the headrail to the route openings down the front of the blind, through the front slots 7, over pulley 88, across the bottomrail 14 under pulley 89 and up the back of the blind through back slots 9 to the headrail through the headrail to the opposite lock and to the operator. One could also provide a pulley arrangement in which four cords are used and each cord goes up and down in the same set of slots. Yet another arrangement would affix one lift cord at the strap away from the cord lock and route it down the front of the blind through the front bottomrail to the other end of the bottomrail, up the front of the blind, and through the front cord lock and the other end of the headrail. A second lift cord would start at the strap near the cord lock and route it down the back of the blind through the back bottomrail up through the back of the blind and then pass through the headrail to the back cord lock and out of the blind. In all of those cord routing patterns the lift cords are in tension at all times preventing lateral motion of the slats.

While the lift cords are always in tension, the rails of the tilt ladders are only in tension when the blind is fully lowered. Since the rails are on the outside edges of the slats they can fold neatly across the front of the blind when the blind is raised to the position shown in FIG. 2. Although such neat folding generally occurs, I prefer to assure that such neat folding always occurs by treating the rails with a permanent pleating or other treatment to provide a memory in the rails so that they will fold in the desired manner.

Figure 11:
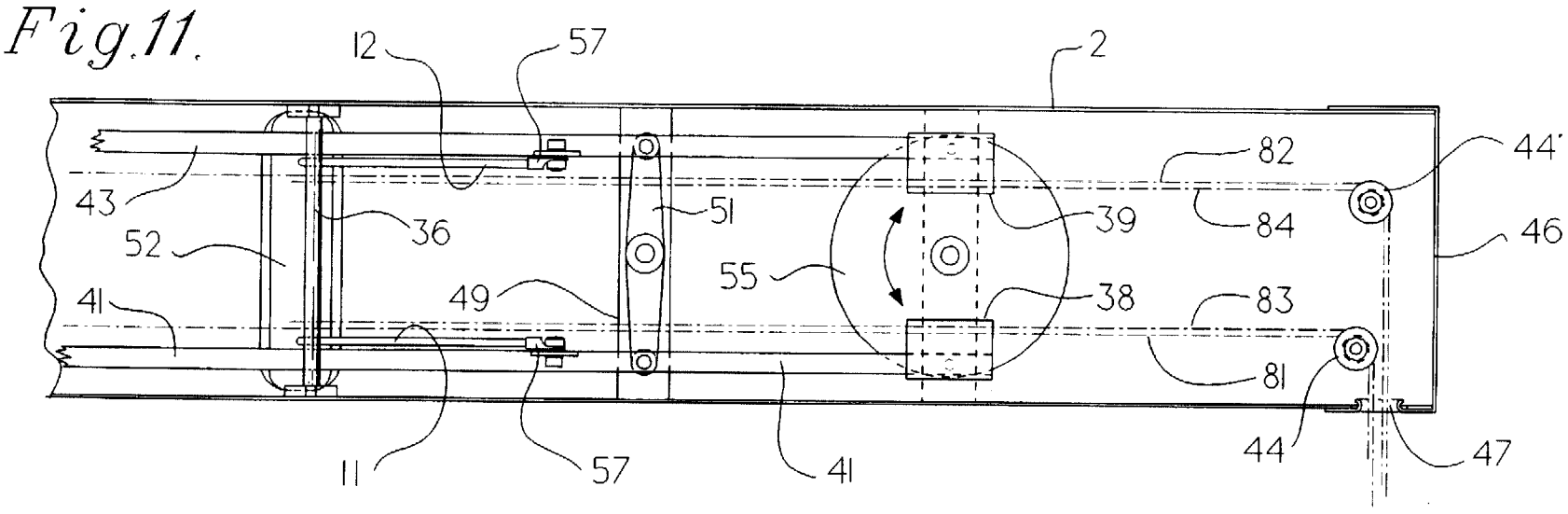
FIG. 11 is a view similar to FIG. 7*b* showing an alternative cording arrangement.

In the embodiment of FIGS. 6*a*, 6*b*, 7*a* and 7*b*, the lift cords 81 and 82 and the ladder rails 11 and 12 are routed outside of the straps 41 and 43. However, I found that routing the cords and ladder rails between the straps 41 and 43 assures that the lift cords and ladder rails will move together as the straps 41 and 43 move together. This cording arrangement is shown in FIG. 11. I also prefer to attach the ends of straps 41 and 43 which carry the cord locks 38 and 39 to disk 55 to provide added support. This disk is similar to tilt driver 45, but is not attached to the tilt cords. The tilt driver disk could be used to support the cord locks. In this case, it is preferred that the tilt cords connect to a mono control system.

Figure 12:
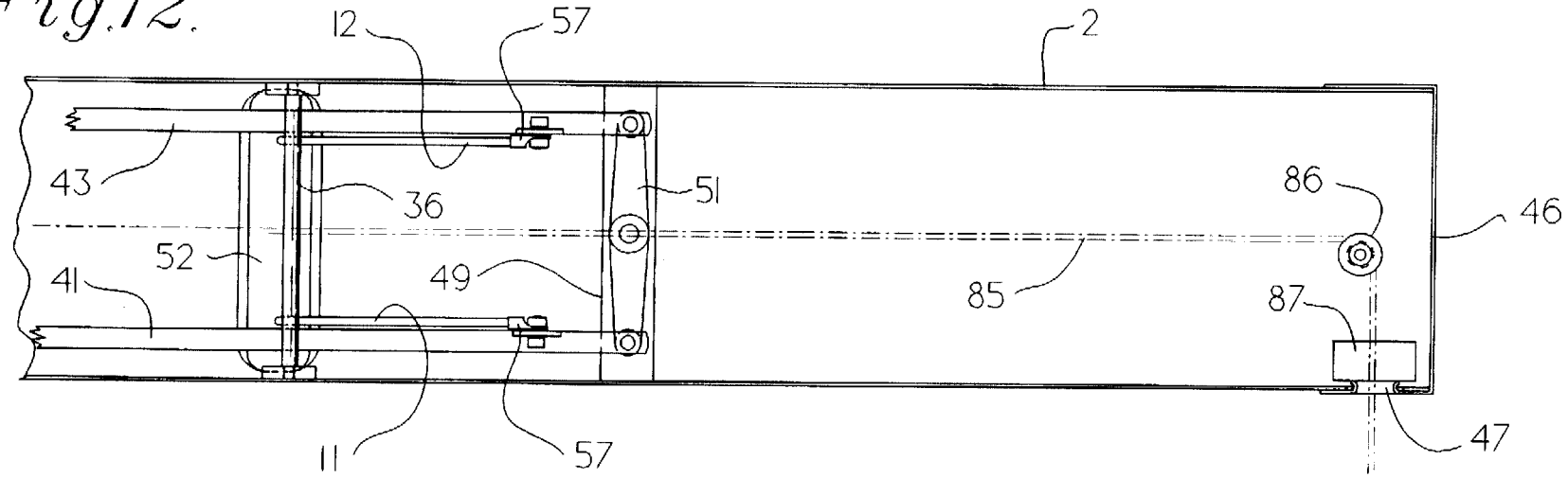
FIG. 12 is a view similar to FIG. 7*b* showing an embodiment having a single lift cord adjacent each ladder.

My tilt mechanism can also be used with blinds having one lift cord rather than two lift cords adjacent each ladder. This single lift cord may run through holes in the center of the slats. A cording arrangement for this embodiment is shown in FIG. 12. Lift cords 85 are routed around pulley 86 through cord lock 87. If desired, the lift cords 85 could be routed directly to cord lock 87 without using a pulley 86.

The straps in the preferred embodiment are lengths of flat spring steel ¼"×0.032" in length, but they could also be straps, cable or rods of steel, fiberglass, metal, or any other material with suitable tensile strength to support the rails 11 and 12 of the tilt ladder 10 that are connected to the straps. The straps 41 and 43 are shown connected to crossbars 51. However, cross-disks could be used in place of crossbars 51.

Although I have shown and described certain present preferred embodiments of my venetian blind it should be distinctly understood that the invention is not limited thereto but may be variously embodied within the scope of the following claims.

I claim:

1. A venetian type blind comprising:

a. a bottomrail;

b. a headrail positioned above the bottomrail;

c. a plurality of ladders each having a front rail, and a rear rail the ladders extending between the headrail and the bottomrail, and d. a tilt mechanism positioned within the headrail the tilt mechanism comprised of:

i. a plurality of bars each bar pivotably attached to the housing for movement about an axis that is generally parallel to the ladder rails of one ladder each bar having a front end and an opposite end;

ii. a front strap connected to the front end of all the bars wherein each of the front rails of the ladders are connected to one of the front strap and the front end of one bar;

iii. a rear strap connected to the rear end of all bars wherein each of the rear rails of the ladder are connected to one of the rear strap and rear end of one bar; and iv. a tilt driver connected to one of the bars such that a force acting on the tilt driver will cause the bars to pivot in one direction and a second force acting on the tilt driver will cause the bars to pivot in an opposite direction such that when the blind is tilted from an open position to a closed position the straps will move together.

2. The blind of claim 1 wherein the bars are disk shaped.

3. The venetian blind of claim 1 also comprising a plurality of lift cords connected to the bottomrail and running into the headrail, a cord lock connected to each strap and through which at least one lift cord passes.

4. The venetian blind of claim 1 also comprising a first pulley and a second pulley positioned in the bottomrail so that one tilt cord passes around a first pulley and a second tilt cord passes around a second pulley.

5. The venetian blind of claim 1 wherein the bottomrail is comprised of a front rail to which the front rails of the ladders are attached and a rear rail to which the rear rails of the ladders are attached.

6. The venetian blind of claim 1 wherein the straps are metal.

7. The venetian type blind of claim 1 wherein each ladder has a plurality of rungs extending between the front rail and the rear rail and also comprising a plurality of slots supported on the rungs.

* * * * *